US009310765B2

(12) United States Patent
Endo

(10) Patent No.: US 9,310,765 B2
(45) Date of Patent: Apr. 12, 2016

(54) IMAGE FORMING APPARATUS

(71) Applicant: Hirotaka Endo, Kanagawa (JP)

(72) Inventor: Hirotaka Endo, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/632,196

(22) Filed: Feb. 26, 2015

(65) Prior Publication Data

US 2015/0253728 A1 Sep. 10, 2015

(30) Foreign Application Priority Data

Mar. 5, 2014 (JP) ..... 2014-042557
Aug. 28, 2014 (JP) ..... 2014-173451

(51) Int. Cl.
*G03G 21/20* (2006.01)
*G03G 15/08* (2006.01)
*G03G 15/20* (2006.01)

(52) U.S. Cl.
CPC ..... *G03G 21/206* (2013.01); *G03G 15/0867* (2013.01); *G03G 15/2039* (2013.01); *G03G 2215/0675* (2013.01); *G03G 2215/0678* (2013.01)

(58) Field of Classification Search
None
See application file for complete search history.

(56) References Cited

U.S. PATENT DOCUMENTS 7,286,784 B2 10/2007 Tanaka
7,302,202 B2 11/2007 Tai et al.
2006/0013605 A1* 1/2006 Tanaka ..... 399/53
2009/0136242 A1 5/2009 Okamoto et al.
2009/0175647 A1* 7/2009 Suzuki ..... 399/92
2013/0287426 A1* 10/2013 Sadamitsu ..... 399/94

FOREIGN PATENT DOCUMENTS

EP 2065765 A1 6/2009
JP 2003-233292 8/2003
JP 2003-302892 10/2003
JP 2006-030572 2/2006
JP 2006-250446 9/2006
JP 2008-064901 3/2008
JP 2010-223994 10/2010
JP 2011-242635 12/2011

OTHER PUBLICATIONS

Extended European Search Report dated Jul. 9, 2015.

* cited by examiner

*Primary Examiner* — Clayton E Laballe
*Assistant Examiner* — Jas Sanghera
(74) *Attorney, Agent, or Firm* — Harness, Dickey & Pierce, P.L.C.

(57) ABSTRACT

An image forming apparatus includes an image forming device to form a toner image on a sheet; a fixing device to fix the toner image on the sheet; a toner container to house the toner to be supplied to the image forming device, the toner container arranged above the fixing device; a cooling fan; a guide to guide an airflow coming from the cooling fan to an outer circumferential surface of the toner container; an outer-circumferential flow path to serve as an airflow path between the outer circumferential surface of the toner container and a wall facing the outer circumferential surface, the outer-circumferential flow path guiding the airflow coming from the guide along the outer circumferential surface; a suction fan to suck the airflow having passed through the outer-circumferential flow path; and an exhaust guide to discharge the sucked airflow.

13 Claims, 8 Drawing Sheets

IMAGE FORMING APPARATUS

CROSS-REFERENCE TO RELATED APPLICATIONS

The present application claims priority to and incorporates by reference the entire contents of Japanese Patent Application No. 2014-042557 filed in Japan on Mar. 5, 2014 and Japanese Patent Application No. 2014-173451 filed in Japan on Aug. 28, 2014.

BACKGROUND OF THE INVENTION

1. Field of the Invention

Embodiments of the present invention relate generally to an image forming apparatus.

2. Description of the Related Art

Image forming apparatuses employing what is referred to as an electrophotographic process are typically configured to replenish toner when an amount of toner in a developing unit which performs development becomes small. Such an image forming apparatus generally includes a toner container where supplemental toner is housed.

A main heat source that increases an ambient temperature in such an image forming apparatus is a fixing device that fixes a not-yet-fixed toner image formed on a sheet media by applying heat and pressure. The toner container is generally arranged at a position above the fixing device where an ambient temperature is likely to increase in the image forming apparatus.

Meanwhile, when the temperature of toner increases excessively high, the toner can be modified, or fused and solidified by the temperature. Examples of known techniques for cooling a toner container to reduce modification and solidification of toner in the toner container are described below. According to a technique disclosed in Japanese Laid-open Patent Application No. 2003-302892, cooling air is blown against an outer circumferential surface of a toner container. According to another technique disclosed in Japanese Laid-open Patent Application No. 2008-064901, a pipe through which cooling fluid flows is arranged near an outer circumferential surface of a toner container.

In recent years, many image forming apparatuses have achieved reduction in size and higher image forming speed, whereby ambient temperatures in the image forming apparatuses are increasing. Meanwhile, toners which can be fixed at lower temperatures are being developed to reduce power consumption and to achieve still higher image forming speeds. However, such toners are more susceptible to the influence of temperature than conventional toners.

The conventional technique disclosed in Japanese Laid-open Patent Application No. 2003-302892 that blows cooling air against the outer circumferential surface of the toner container is disadvantageous in that the blown air can stagnate at around the toner container. If images are successively formed on multiple sheets of media in this condition, the ambient temperature at around the toner container is likely to increase. Heat transferred from the ambient temperature and radiant heat from components around the toner container will likely increase the temperature of the toner container as well.

As described above, it is becoming difficult to cool a toner container of a recent image forming apparatus, in which ambient temperatures tend to be increasing, effectively enough to reduce modification and solidification of toner using the conventional technique of simply blowing air against an outer circumferential surface of the toner container. Furthermore, such difficulty will be further added by advent of toners which can be fixed at lower temperatures in the future.

Therefore, there is a need for an image forming apparatus capable of effectively cooling a toner container.

SUMMARY OF THE INVENTION

It is an object of the present invention to at least partially solve the problems in the conventional technology.

According to an embodiment, there is provided an image forming apparatus that includes an image forming device to form a toner image on a sheet; a fixing device to fix the toner image on the sheet; a toner container to house the toner to be supplied to the image forming device, the toner container arranged above the fixing device; a cooling fan; a guide to guide an airflow coming from the cooling fan to an outer circumferential surface of the toner container; an outer-circumferential flow path to serve as an airflow path between the outer circumferential surface and a wall facing the outer circumferential surface, the outer-circumferential flow path guiding the airflow coming from the guide along the outer circumferential surface; a suction fan to suck the airflow having passed through the outer-circumferential flow path; and an exhaust guide to discharge the airflow sucked by the suction fan.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings.

An image forming apparatus according to an embodiment of the present invention is described below. A basic configuration of the image forming apparatus is described first. FIG.

Figure 1:
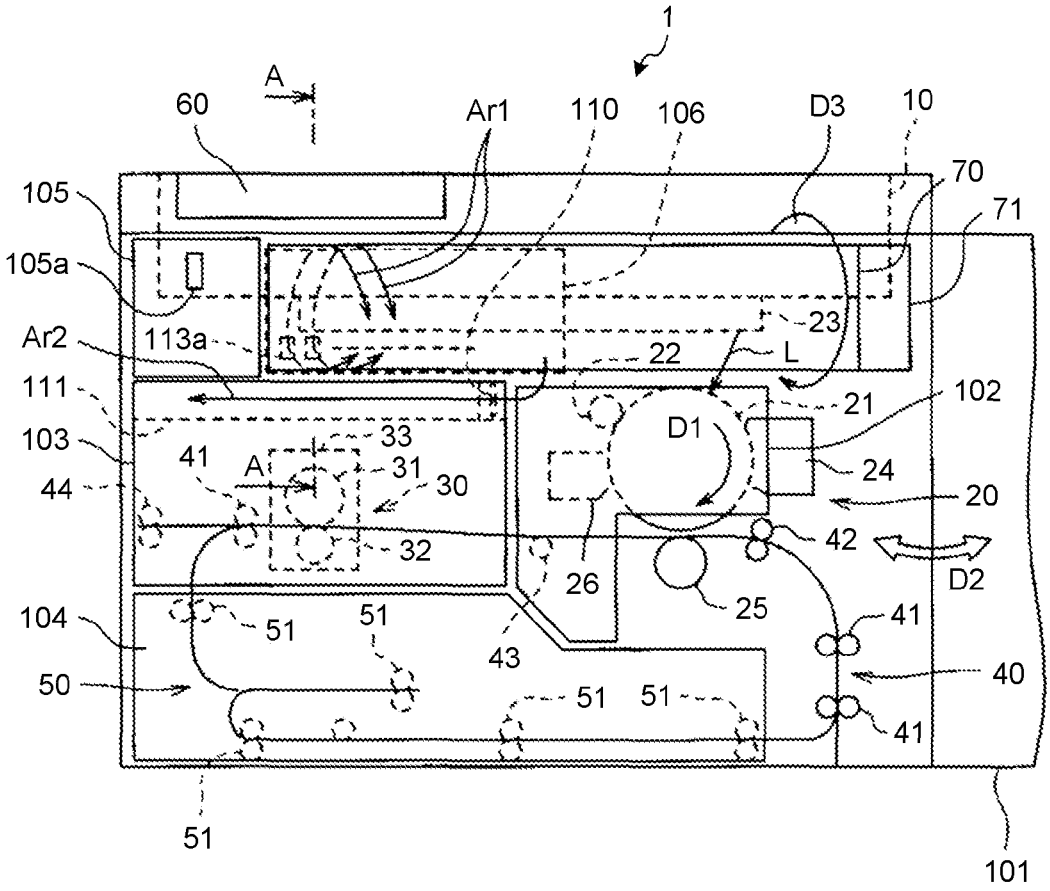
FIG. 1 is a schematic configuration diagram illustrating a basic configuration of an image forming apparatus according to an embodiment of the present invention.

1 is a schematic configuration diagram illustrating the basic configuration of the image forming apparatus according to the embodiment. The configuration of an upper portion of an image forming apparatus 1, which is a monochrome copier, is illustrated in FIG. 1, but illustration of a configuration of a lower portion including a sheet feeding unit is omitted.

Note that the image forming apparatus referred to in this specification is not limited to a monochrome image forming apparatus, and may alternatively be a color image forming apparatus. The image forming apparatus referred to in this specification is not limited to a copier, and may alternatively be a printer, a facsimile, a multifunction peripheral having functions of a printer and a copier, or the like.

The image forming apparatus 1 includes a reading unit 10, an image forming device 20, a fixing device 30, a sheet conveyance unit 40, a sheet reversing unit 50, an operating unit 60, and a toner container 70. The reading unit 10 scans an original document using a preset optical system to thereby read an image of the original document, and generates image data representing the image of the document. The image forming device 20 forms a toner image on a sheet media (hereinafter, sometimes referred to as "sheet") in accordance with the image data.

The image forming device 20 includes a photoconductor drum 21, a charging device 22, a writing unit 23, a developing unit 24, a transfer unit 25, and a cleaning unit 26. The photoconductor drum 21 is arranged below the reading unit 10 and driven to rotate in a direction indicated by arrow D1 in FIG. 1. The charging device 22, the developing unit 24, the transfer unit 25, and the cleaning unit 26 are arranged around the photoconductor drum 21 in this order along the rotating direction (the direction indicated by the arrow D1) of the photoconductive drum 21. The writing unit 23 is arranged between the reading unit 10 and the photoconductor drum 21. In the image forming device 20, the charging device 22 deposits charges on an outer circumferential surface of the photoconductor drum 21. The writing unit 23 writes an electrostatic latent image to the outer circumferential surface with writing light L modulated in accordance with the image data. The developing unit 24 develops the electrostatic latent image into a toner image using toner. The transfer unit 25 transfers the toner image onto a sheet conveyed by the sheet conveyance unit 40 to the transfer unit 25. The cleaning unit 26 removes residual toner and the like from the outer circumferential surface of the photoconductor drum 21 from which the toner image has been transferred. The image forming device 20 is an example of the image forming device according to aspects of the invention.

In the embodiment, the image forming device 20 which directly transfers a toner image from the photoconductor drum 21 to a sheet is employed as an example of the image forming device according to aspects of the invention. However, the image forming device according to aspects of the invention is not limited to such a configuration, and may alternatively be configured to indirectly transfer a toner image from the photoconductor drum 21 to a sheet via a certain intermediate transfer member.

The fixing device 30 includes a heating roller 31 and a pressure roller 32. The fixing device 30 fixes the not-yet-fixed toner image, which is on the sheet conveyed from the image forming device 20 by the sheet conveyance unit 40, onto the sheet by heat and pressure applied by the heating roller 31 and the pressure roller 32, respectively. The heating roller 31 and the pressure roller 32 are housed in a casing 33. The fixing device 30 is an example of the fixing device according to aspects of the present invention.

In the embodiment, the fixing device 30 including the heating roller 31 as a heating member is employed as an example of the fixing device according to aspects of the invention is. However, the fixing device according to aspects of the invention is not limited thereto, and may alternatively be configured to include a pressure roller and an endless-belt-shaped fixing belt configured to be revolved while being heated by a certain heat source, for example.

The sheet conveyance unit 40 includes multiple pairs of conveyance rollers 41, a pair of registration rollers 42, a conveyance roller 43, and a pair of ejection rollers 44. These members are arranged in the sheet conveyance unit 40 along a conveyance path extending through the image forming device 20 and the fixing device 30 from the sheet feeding unit (now shown). A sheet fed from the sheet feeding unit is conveyed by the pairs of conveyance rollers 41 to the pair of registration rollers 42. The pair of registration rollers 42 delivers the sheet to a nip between the photoconductor drum 21 and the transfer unit 25. This delivery is timed so that the sheet reaches the nip when the toner image on the outer circumferential surface of the photoconductor drum 21 reaches the transfer unit 25. The sheet to which the toner image is transferred by the transfer unit 25 is conveyed by the conveyance roller 43 to the fixing device 30 with the toner image facing upward. The sheet on which the toner image is fixed is further conveyed by the pairs of conveyance rollers 41 and ejected by the pair of ejection rollers 44. The image forming apparatus 1 according to the embodiment is configured to be capable of duplex image forming. In a simplex image-forming mode, the sheet is ejected by the pair of ejection rollers 44 immediately after the toner image is fixed. By contrast, in a duplex image-forming mode, the sheet is delivered to the sheet reversing unit 50 by the pair of conveyance rollers 41 arranged between the fixing device 30 and the pair of ejection rollers 44.

The sheet reversing unit 50 includes multiple pairs of reversing conveyance rollers 51. The multiple pairs of reversing conveyance rollers 51 are arranged along a reversing path for reversing the sheet upside down so that a back side in relation to the image-formed side faces the photoconductor drum 21. The reversed sheet is delivered to the sheet conveyance unit 40. The sheet is conveyed through the image forming device 20 and the fixing device 30, whereby an image is formed on the back side of the sheet. The sheet on the back side of which the image is formed is ejected by the pair of ejection rollers 44.

The operating unit 60 is a unit for accepting user inputs made on the image forming apparatus 1. The operating unit 60 is on a top surface of the image forming apparatus 1 at a position above the fixing device 30 on a side (hereinafter, the "front-surface side") of a front surface as viewed from a user. Preferences including, for example, the number of copies to be printed (i.e., image formed) and either the simplex image-forming mode or the duplex image-forming mode are set via the operating unit 60. Meanwhile, the side of the image forming apparatus 1 illustrated in FIG. 1 corresponds to the front-surface side of the image forming apparatus 1 as viewed from the user.

The toner container 70 houses supplemental toner to be supplied to the developing unit 24 when an amount of the toner in the developing unit 24 of the image forming device 20 becomes small. The toner container 70 having a cylindrical (or, in other words, bottle-like) shape is rotatably supported by a container holder 71 at a position above the fixing device 30 in a manner that allows detaching the toner container 70. The toner container 70 is to be replaced with a new one as appropriate when the amount of toner in the toner container 70 becomes small. The toner container 70 is driven to rotate by a drive source (not shown) in a direction indicated by arrow D3 in FIG. 1. The toner container 70 is an example of the toner container according to aspects of the invention.

In the image forming apparatus 1, the front surface as viewed from a user is covered with a front door 101 which is to be opened and closed at maintenance and like occasions by a user in directions indicated by arrow D2. FIG. 1 illustrates a state in which the front door 101 is open and positioned to the right of the image forming apparatus 1 (with a portion of the front door 101 on the movable-end side omitted from FIG. 1). The image forming apparatus 1 includes multiple inner covers to prevent the above-described inner structure from being exposed when the front door 101 is open so that a required level of quality in appearance is maintained. More specifically, the image forming apparatus 1 includes an image-forming-unit inner cover 102, a fixing-ejection-zone inner cover 103, a sheet-reversing-unit inner cover 104, and a switch inner cover 105. The image-forming-unit inner cover 102 covers the image forming device 20 from the front-surface side. The fixing-ejection-zone inner cover 103 covers the fixing device 30 and the pair of ejection rollers 44 from the front-surface side. The sheet-reversing-unit inner cover 104 covers the sheet reversing unit 50 from the front-surface side. The switch inner cover 105 is arranged to the left, in FIG. 1, of the toner container 70 next thereto. A power supply switch 105*a* is arranged on the switch inner cover 105.

The image forming apparatus 1 further includes, at a position more inside than the toner container 70, an inside-than-container inner cover 106 which prevents an inner structure on the inner side than the toner container 70 from being exposed at replacement of the toner container 70 with a new one.

In the image forming apparatus 1 described above, the temperature of the heating roller 31 of the fixing device 30 during an image forming process reaches as high as 180° C. (degrees Celsius) to 200° C. The heating roller 31 cased in the casing 33 is basically configured to prevent leakage of high-temperature ambient air around the heating roller 31 out from the fixing device 30. However, the casing 33 has openings at opposite ends of the heating roller 31 extending perpendicularly to the plane of paper in FIG. 1 for structural reason of a rotating mechanism and the like. Accordingly, because the high-temperature ambient air can leak out from the casing 33 through the openings and rise by natural convection, temperatures of components positioned above the opposite ends of the heating roller 31 are likely to increase.

In the image forming apparatus 1, the toner container 70 is arranged above one (hereinafter, the "front-side end of the heating roller 31") of the ends of the heating roller 31 on the front-surface side. Accordingly, the temperature of the toner container 70 is likely to increase at a portion immediately above the front-side end of the heating roller 31. When the temperature of toner increases excessively high, the toner can be modified, or fused and solidified under the influence of temperature. Furthermore, the under-development toners which can be fixed at lower temperatures are more susceptible to the influence of temperature than conventional toner.

Under the circumstances, the image forming apparatus 1 is configured to produce airflow of cooling air as follows to cool the portion, which is immediately above the front-side end of the heating roller 31 and therefore at which the temperature is likely to increase, of the toner container 70. The cooling air comes out from multiple air exit openings 113*a* provided in the inside-than-container inner cover 106. The thus-blown air flows to a portion (hereinafter, "the front portion") on the front-surface side of the image forming apparatus 1 in directions indicated by arrows Ar1 to circumferentially surround the portion, which is immediately above the front-side end of the heating roller 31, of the outer circumferential surface of the toner container 70. The air moved to the front portion is sucked by a suction fan 110, which will be described in detail later. An exhaust duct 111 for discharging the air sucked by the suction fan 110 to inner side of the image forming apparatus 1 away from the outer circumferential surface of the toner container 70 is arranged in a top portion of the fixing-ejection-zone inner cover 103. The air sucked by and exiting from the suction fan 110 flows leftward in FIG. 1 in a direction indicated by arrow Ar2 through the exhaust duct 111 to be discharged to the inner side of the image forming apparatus 1. The air that flows without stagnating in this manner cools the portion, which is immediately above the front-side end of the heating roller 31 and at which the temperature is likely to increase, of the toner container 70.

As another scheme than the scheme of the embodiment, a scheme of sucking and discharging the high-temperature ambient air around the fixing device 30, thereby preventing uplift of the high-temperature ambient air by natural convection can be employed. However, such air suction and discharge also act to lower the temperature of the heating roller 31 of the fixing device 30. Power supply to a heater (not shown) in the fixing device 30 is adjusted to maintain the temperature of the heating roller 31 in a range of 180° C. to 200° C. Accordingly, such air suction and discharge as that described above will disadvantageously result in an increase in the power supply to the heater. By contrast, according to the embodiment, suction and discharge of air around the fixing device 30 is not performed but the portion, which is immediately above the front-side end of the heating roller 31 and at which the temperature is likely to increase, of the toner container 70 is cooled. Accordingly, an increase in the power supply to the heater can be reduced.

Figure 2:
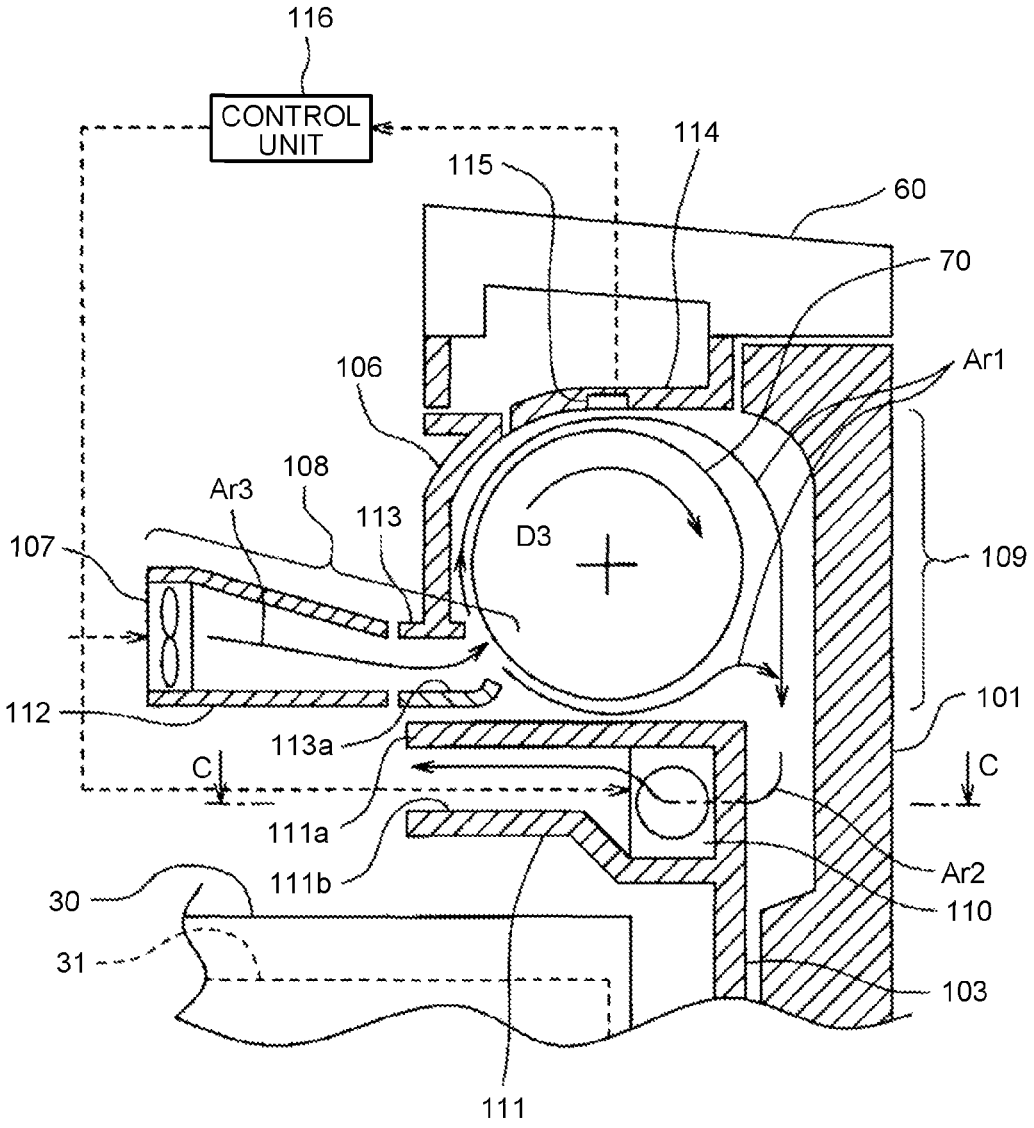
FIG. 2 is a diagram illustrating a cross section of the image forming apparatus illustrated in FIG. 1 taken along the line A-A in FIG. 1.

A configuration for producing such a cooling airflow as that described above is described below. FIG. 2 is a cross section of the image forming apparatus 1 illustrated in FIG. 1 taken along the line A-A in FIG. 1. A cooling fan 107, a cooling duct 108 corresponding to a guide, an airflow path 109 corresponding to an outer-circumferential flow path, the suction fan 110, and the exhaust duct 111 corresponding to an exhaust guide are arranged around the toner container 70 to produce the cooling airflow. Meanwhile, the front-surface side of the image forming apparatus 1 in FIG. 1, which corresponds to the side of the image forming apparatus 1 illustrated in FIG. 1, is on the right side in FIG. 2. The front door 101, which is in the open state in FIG. 1, is in a closed state in FIG. 2.

The cooling fan 107 is a fan for creating the airflow for cooling the toner container 70. The cooling fan 107 sucks air, the temperature of which is substantially same as that of outside air (which will be described in detail later) for use in cooling the writing unit 23 illustrated in FIG. 1. The cooling fan 107 is an example of the cooling fan according to aspects of the invention.

The cooling duct 108 is a duct which guides the air coming from the cooling fan 107 to near the outer circumferential surface of the toner container 70 in a direction indicated by arrow Ar3 and causes the air to be blown against the outer circumferential surface. The cooling duct 108 includes an inlet duct 112 and an outlet duct 113. The cooling fan 107 is arranged near an entrance of the inlet duct 112. The outlet duct 113 is formed in a lower portion of the inside-than-container inner cover 106 to be a part of the inside-than-container inner cover 106.

Figure 3:
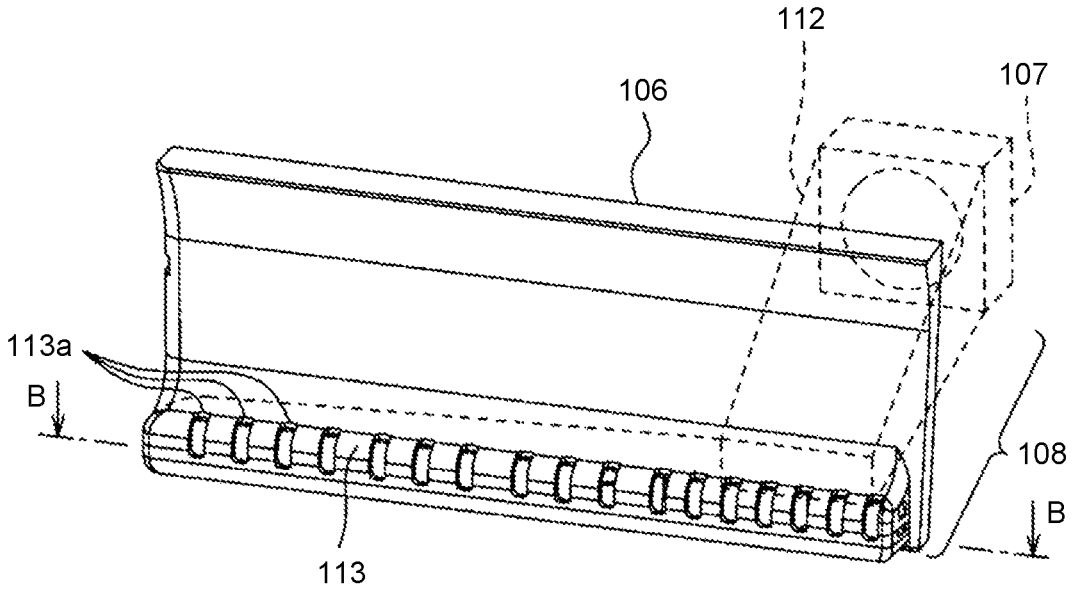
FIG. 3 is a perspective view illustrating a cooling duct.
Figure 4:
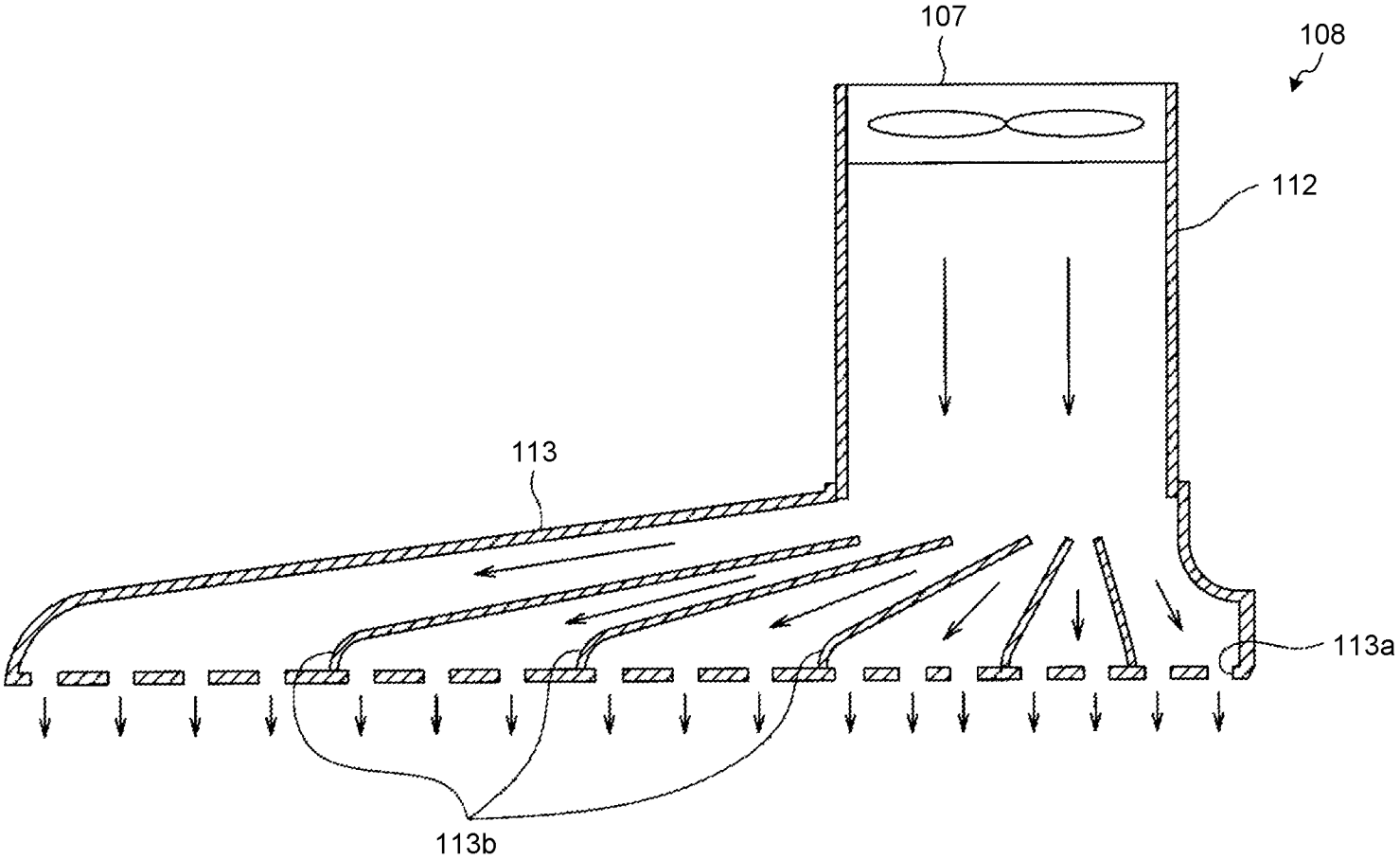
FIG. 4 is a diagram illustrating a cross section of the cooling duct taken along the line B-B in FIG. 3.

FIG. 3 is a perspective view illustrating the cooling duct. FIG. 4 is a cross section of the cooling duct taken along the line B-B in FIG. 3. In FIG. 3, both the inlet duct 112 and the cooling fan 107 are indicated by dashed lines for convenience of viewing the shape of the outlet duct 113. Meanwhile, the front-surface side of the image forming apparatus 1 in FIG. 1, which corresponds to the side of the image forming apparatus 1 illustrated in FIG. 1, is on the viewer's side in FIG. 3 which is a perspective view. The front-surface side of the image forming apparatus 1 is on the right side in FIG. 4.

The lower portion of the inside-than-container inner cover 106 projects toward the outer circumferential surface of the toner container 70 to form a hollow structure as the outlet duct 113. The inlet duct 112 is joined to the outlet duct 113 on the side opposite from the toner container 70. The multiple air exit openings 113*a*, which are at a distal edge of the outlet duct 113 on the side of the outer circumferential surface of the toner container 70, are aligned in a longitudinal direction of the inside-than-container inner cover 106. The air flowing into the inlet duct 112 passes through the outlet duct 113 to come out from the multiple air exit openings 113*a* and impinge on the outer circumferential surface of the toner container 70.

The inlet duct 112 has the shape of a straight pipe extending with a width substantially same as that of the cooling fan 107. The outlet duct 113 has the shape of a tapered pipe expanding from the position, at which the outlet duct 113 is joined to the inlet duct 112, with its width increasing to a substantially same width as the width of the inside-than-container inner cover 106 in the longitudinal direction. The inlet duct 112 is arranged at a position closer to one end of the outlet duct 113 in the longitudinal direction of the outlet duct 113 than to the other end. As illustrated in FIG. 4, multiple cooling-duct flow-smoothing plates 113*b* which guide air from an exit of the inlet duct 112 to the multiple air exit openings 113*a* are arranged inside the outlet duct 113 in a radial pattern. Intervals and positions of the multiple cooling-duct flow-smoothing plates 113*b* are adjusted so that the amount of air reaching the air exit openings 113*a* varies in a manner that the amount increases toward the fixing device 30. The cooling-duct flow-smoothing plates 113*b* are an example of the guide flow-smoothing plates according to aspects of the invention.

As illustrated in FIG. 2, the outlet duct 113 has the cross section upwardly curved toward the outer circumferential surface of the toner container 70. This shape of the outlet duct 113 causes the air coming out from the multiple air exit openings 113*a* to impinge on the outer circumferential surface of the toner container 70 substantially perpendicularly.

Figure 5:
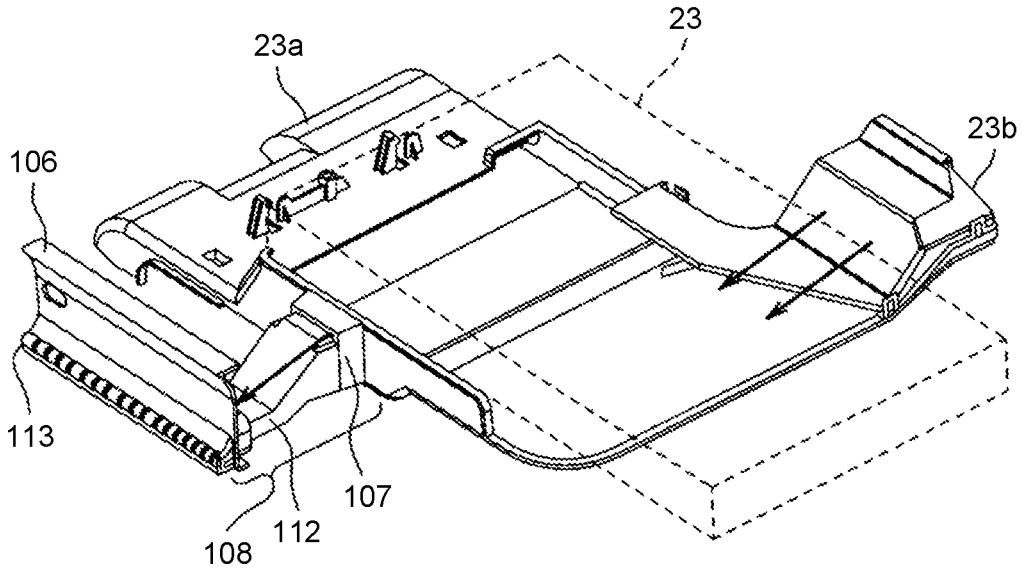
FIG. 5 is a diagram illustrating how air for use in cooling a writing unit, which is illustrated in FIG. 1, is delivered by a cooling fan into the cooling duct.
Figure 6:
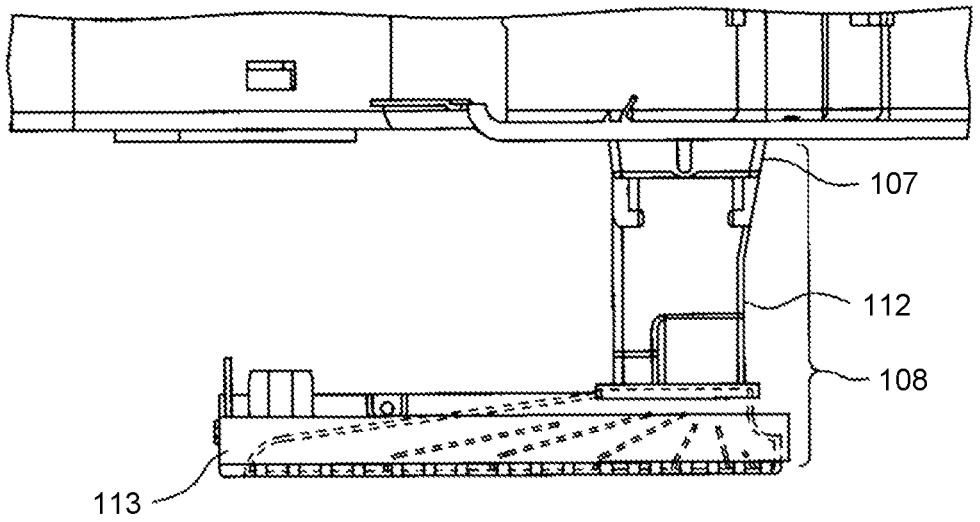
FIG. 6 is a top view of an inlet duct, an inside-than-container inner cover, and an outlet duct, which are illustrated in FIG. 5.

In the image forming apparatus 1 according to the embodiment, the air delivered by the cooling fan 107 into the cooling duct 108 is the air for use in cooling the writing unit 23. FIG. 5 is a diagram illustrating how the air for use in cooling the writing unit illustrated in FIG. 1 is delivered by the cooling fan into the cooling duct. FIG. 6 is a top view of an inlet duct, an inside-than-container inner cover, and an outlet duct which are illustrated in FIG. 5. As illustrated in FIGS. 5 and 6, in the embodiment, the air for use in cooling the writing unit 23 described above is delivered by the cooling fan 107 into the inlet duct 112 of the cooling duct 108. Meanwhile, the front-surface side of the image forming apparatus 1 in FIG. 1, which corresponds to the side of the image forming apparatus 1 illustrated in FIG. 1, is on the bottom left side in FIG. 5 which is a perspective view. The front-surface side of the image forming apparatus 1 is on the bottom side in FIG. 6.

The writing unit 23 includes a writing-unit cooling duct 23*a* through which the air for cooling the writing unit 23 flows. A writing-unit cooling fan 23*b* which draws air from outside the image forming apparatus 1 into the writing-unit cooling duct 23*a* is arranged in the writing-unit cooling duct 23*a*. Because a not large amount of heat is absorbed in the writing-unit cooling duct 23*a*, the temperature of the air flowing inside the writing-unit cooling duct 23*a* is substantially same as the temperature of the outside air drawn in by the writing-unit cooling fan 23*b*. For instance, when the temperature of the outside air is 32° C., the temperature of the air flowing inside the writing-unit cooling duct 23*a* may be approximately 35° C.

The inlet duct 112 of the cooling duct 108 is jointed to the writing-unit cooling duct 23*a* at a midpoint thereof. The cooling fan 107 is arranged at the joint position. The air, the temperature of which is substantially same as the temperature of the outside air, flowing inside the writing-unit cooling duct 23*a* is delivered into the inlet duct 112 by being sucked by the cooling fan 107.

The air, the temperature of which is substantially same as the temperature of the outside air, flows from the inlet duct 112 into the outlet duct 113 and comes out from the multiple air exit openings 113*a* to impinge on the outer circumferential surface of the toner container 70 substantially perpendicularly. As illustrated in FIG. 2, the air caused to impinge on the surface flows through the airflow path 109 along the outer circumferential surface of the toner container 70 while being vertically divided as indicated by the arrows Ar1. The airflow path 109 defined by the outer circumferential surface of the toner container 70 and walls (which are described below) facing the outer circumferential surface is a path through which the air coming out from the cooling duct 108 flows to circumferentially surround the outer circumferential surface.

As illustrated in FIG. 2, the airflow path 109 is defined by the outer circumferential surface of the toner container 70, and the inside-than-container inner cover 106 described above, an operating-unit inner cover 114, the front door 101, and an upper wall 111*a* of the exhaust duct 111. The airflow path 109 is an example of the outer-circumferential flow path according to aspects of the invention.

The operating-unit inner cover 114 extending between the operating unit 60 illustrated in FIG. 1 and the toner container 70 guides air moving upward along the outer circumferential surface of the toner container 70 to the front portion. The front door 101 covers, in its closed state, the front surface of the image forming apparatus 1 and faces the outer circumferential surface of the toner container 70 from the front-surface side.

The exhaust duct 111 is formed in the top portion of the above-described fixing-ejection-zone inner cover 103 to be a part of the fixing-ejection-zone inner cover 103. The exhaust duct 111 arranged between the fixing device 30 and the toner container 70 has the shape of a hollow cover extending so as to conceal the toner container 70 in top view of the fixing device 30. The upper wall 111*a* of the exhaust duct 111 faces the outer circumferential surface of the toner container 70 from below the toner container 70.

The air coming out from the cooling duct 108 is vertically divided by being impinged on the outer circumferential surface of the toner container 70. A part of the air directed upward flows toward the front portion through between the outer circumferential surface of the toner container 70, and the inside-than-container inner cover 106, the operating-unit inner cover 114, and the front door 101 as indicated by one of the arrows Ar1. The other part of the air directed downward flows toward the front portion through between the outer circumferential surface of the toner container 70 and the upper wall 111*a* of the exhaust duct 111 as indicated by the other one of the arrows Ar1. These parts of the air merge at the front portion.

In the image forming apparatus 1 according to the embodiment, the distance between the outer circumferential surface of the toner container 70 and each of the above-described walls is set to a small value(s) of approximately 5 millimeters to 10 millimeters so that the air flows through the airflow path 109 as close to the outer circumferential surface of the toner container 70 as possible.

In the image forming apparatus 1 according to the embodiment, as can be seen from FIG. 1, the airflow path 109 is configured to surround an approximately longitudinal half of the outer circumferential surface of the toner container 70 on the side close to the fixing device 30. This configuration of the airflow path 109 causes the cooling air to flow in a manner to converge to the portion which is close to the fixing device 30 and therefore at which the temperature is likely to increase. The length of the airflow path 109 in the longitudinal direction of the toner container 70 depends on this longitudinal length of the inside-than-container inner cover 106.

The air passed through the airflow path 109 described above to the front portion on the side of the front surface of the image forming apparatus 1 is sucked by the suction fan 110 at the front portion. As illustrated in FIG. 1, the suction fan 110 is arranged at top-right corner, in FIG. 1, of the fixing-ejection-zone inner cover 103. The air passed through the airflow path 109 is delivered by the suction fan 110 into the exhaust duct 111 arranged in the top portion of the fixing-ejection-zone inner cover 103.

In the image forming apparatus 1 according to the embodiment, inner side of the front door 101, which is one of the walls that define the airflow path 109, is internally concaved to guide the air traveled to the front-surface side of the toner container 70 to the suction fan 110. Accordingly, the air passed through the airflow path 109 is smoothly sucked by the suction fan 110. By thus being sucked and delivered by the suction fan 110, the air flows through the exhaust duct 111 from the right side to the left side in FIG. 1 in the direction indicated by the arrow Ar2. Furthermore, the exhaust duct 111 has the air vent 111*b* for discharging the air flowing inside the exhaust duct 111 in the direction away from the outer circumferential surface of the toner container 70 as illustrated in FIG. 2. The air flowing inside the exhaust duct 111 is discharged from the air vent 111*b* to the inner side of the image forming apparatus 1.

The maximum flow rate of the suction fan 110 is preferably set to be equal to or greater than the maximum flow rate of the cooling fan 107 to enhance smoothness of the flow of air in the airflow path 109. The image forming apparatus 1 according to the embodiment employs, as the suction fan 110, a sirocco fan that operates at a higher static pressure and induces a greater suction force than a fan of other type. The suction fan 110 is an example of the suction fan according to aspects of the invention.

Figure 7:
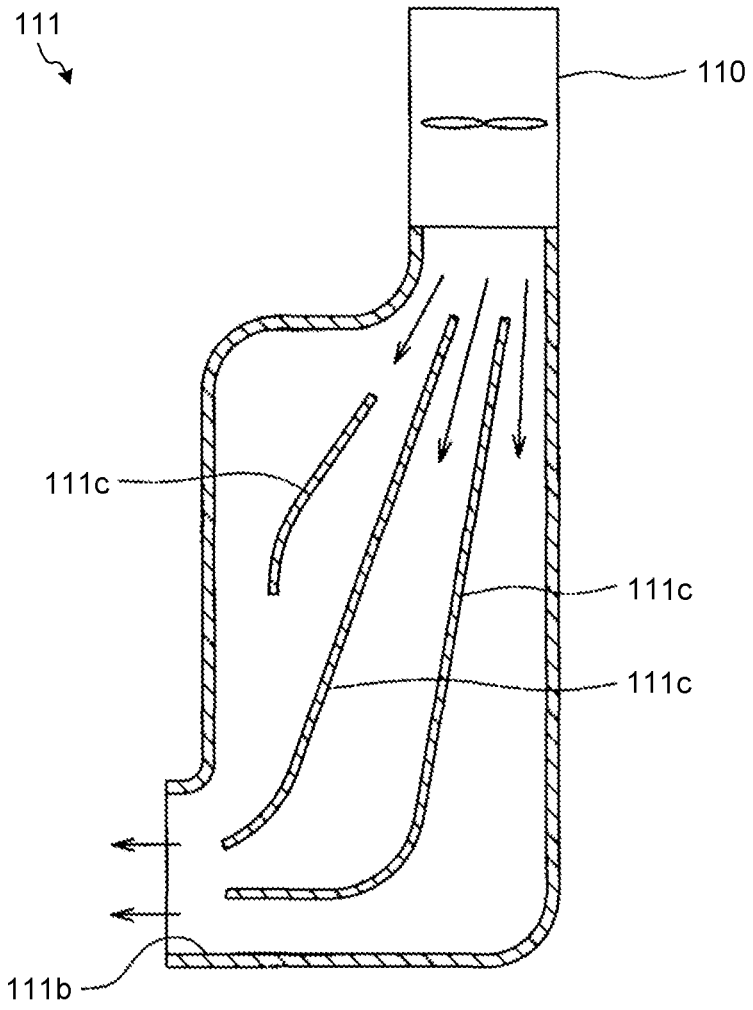
FIG. 7 is a diagram illustrating a cross section of an exhaust duct taken along the line C-C in FIG. 2.

FIG. 7 is a cross section of the exhaust duct taken along the line C-C in FIG. 2. The exhaust duct 111 is a hollow duct substantially having the shape of a rectangular plate. The suction fan 110 is arranged at top-right corner (which is on the front-surface side of the image forming apparatus 1), in FIG. 7, of the exhaust duct 111. The air vent 111*b* is open at bottom-left corner, in FIG. 7, of the exhaust duct 111 toward the inner side of the image forming apparatus 1. Furthermore, multiple exhaust-duct flow-smoothing plates 111*c* each extending from near the top-right corner toward the bottom-left corner as illustrated in FIG. 7 are arranged inside the exhaust duct 111. The multiple exhaust-duct flow-smoothing plates 111*c* guide the air coming from the suction fan 110 so that the air is distributed substantially evenly in the exhaust duct 111 and thereafter discharged from the air vent 111*b*. The exhaust-duct flow-smoothing plates 111*c* are an example of the exhaust-guide flow-smoothing plates according to aspects of the invention. Meanwhile, the front-surface side of the image forming apparatus 1 in FIG. 1, which corresponds to the side of the image forming apparatus 1 illustrated in FIG. 1, is on the right side in FIG. 7.

The image forming apparatus 1 according to the embodiment includes a temperature sensor 115, which corresponds to a temperature detector, on the operating-unit inner cover 114 located above the toner container 70. The temperature sensor 115 is a sensor arranged near the outer circumferential surface of the toner container 70 to detect an ambient temperature near the outer circumferential surface. The image forming apparatus 1 includes a control unit 116 which controls the rotation speed of the cooling fan 107 and that of the suction fan 110 according to the ambient temperature detected by the temperature sensor 115 as described below.

Figure 8:
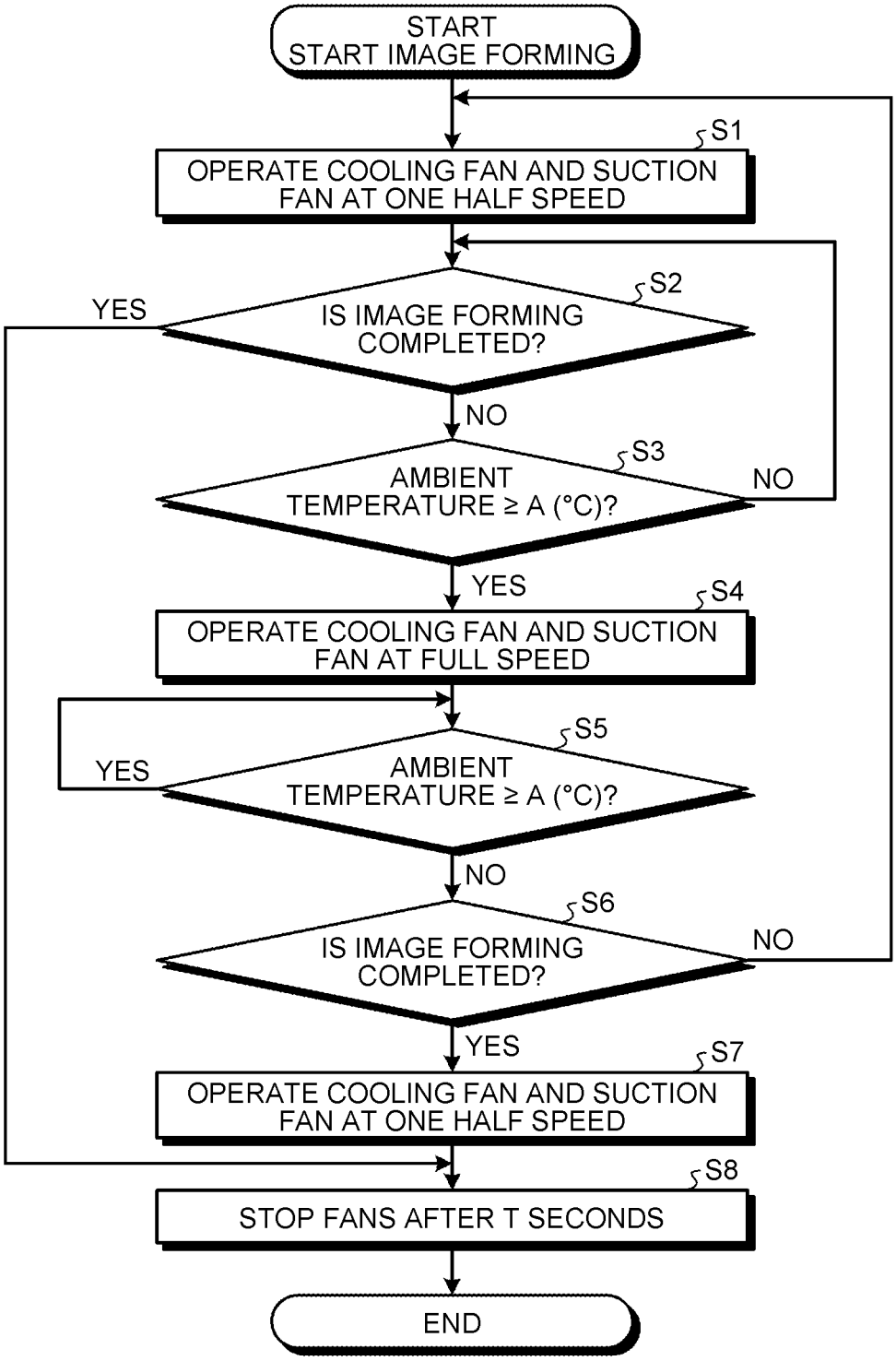
FIG. 8 is a flowchart illustrating a procedure for a control operation performed by a control unit.

FIG. 8 is a flowchart illustrating a procedure for the control operation performed by the control unit. The control operation illustrated in the flowchart starts when the image forming apparatus 1 starts image forming in response to, for example, an operation performed by a user using the operating unit 60 and is performed concurrently with the image forming.

At start of the control operation, the control unit 116 causes each of the cooling fan 107 and the suction fan 110 to operate at one half speed (Step S1). Thereafter, the control unit 116 determines whether or not the image forming, which is performed concurrently with the control operation, is completed (Step S2). If the image forming is not completed yet (NO at Step S2), the control unit 116 determines whether or not the ambient temperature detected by the temperature sensor 115 is equal to or higher than a threshold temperature A which may be, for example, 38° C. (Step S3). If the ambient temperature detected by the temperature sensor 115 is lower than the threshold temperature A (NO at Step S3), control goes back to Step S2 to repeat the determination at Step S2. Meanwhile, the control unit 116 receives the ambient temperature from the temperature sensor 115 at detection intervals X of, for example, every 60 seconds. The control unit 116 repeats the determination at Step S3 at the detection intervals X. If the image forming is completed (YES at Step S2) with the ambient temperature detected by the temperature sensor 115 remaining lower than the threshold temperature A (NO at Step S3), control goes to Step S8.

If the ambient temperature is determined to be equal to or higher than the threshold temperature A at Step S3 (YES at Step S3), the control unit 116 causes each of the cooling fan 107 and the suction fan 110 to operate at full speed (Step S4). Thereafter, the control unit 116 determines whether or not the ambient temperature detected by the temperature sensor 115 is equal to or higher than the threshold temperature A again (Step S5). The determination at Step S5 is repeated until the ambient temperature detected by the temperature sensor 115 falls below the threshold temperature A (NO at Step S5). The control unit 116 repeats the determination at Step S5 at the detection intervals X as at Step S3. If the detected ambient temperature is lower than the threshold temperature A (NO at Step S5), the control unit 116 determines whether or not the image forming is completed (Step S6). If the image forming is not completed yet but in progress (NO at Step S6), control goes back to Step S1 to repeat Step S1 and subsequent Steps. If the image forming is completed (YES at Step S6), control goes to Step S7.

At Step S7, the control unit 116 brings the rotation speed of the cooling fan 107 and the suction fan 110 back to the one half speed (Step S7). The control unit 116 causes this one-half-speed operation to continue for a pre-stop duration T, which may be 60 seconds, for example, and thereafter stops the cooling fan 107 and the suction fan 110 (Step S8). If it is determined that the image forming is completed at Step S2, the image forming is completed in a state where the ambient temperature is lower than the threshold temperature A and the cooling fan 107 and the suction fan 110 remain operating at the one half speed. Accordingly, in this case, control goes to Step S8 as described above so that the cooling fan 107 and the suction fan 110 are stopped after the one-half-speed operation is maintained for the pre-stop duration T. At completion of Step S8, the control operation illustrated in the flowchart in FIG. 8 ends.

The effect of cooling the toner container 70 exerted by provision of the cooling fan 107, the cooling duct 108, the airflow path 109, the suction fan 110, and the exhaust duct 111 is described below. The cooling effect is verified by carrying out the experiment described below. In this experiment, the image forming apparatus 1 according to the embodiment was operated continuously for three hours to form predetermined test images in a controlled temperature environment of 32° C. Note that this image forming was performed without performing the control operation of the flowchart illustrated in FIG. 8, and the cooling fan 107 and the suction fan 110 were operated at full speed all through the image forming. The temperature at a position near the bottom of the toner container 70 or, in other words, immediately above the fixing device 30, was measured every hour.

As Comparative Examples, two image forming apparatuses described below were prepared. An image forming apparatus of Comparative Example 1 was obtained by removing the cooling fan 107, the cooling duct 108, and the suction fan 110 from the image forming apparatus 1 according to the embodiment and attaching a cooling fan to the operating-unit inner cover 114 illustrated in FIG. 2. In the image forming apparatus of Comparative Example 1, the cooling fan blows air against the toner container 70 from above.

An image forming apparatus of Comparative Example 2 was obtained by removing the cooling fan 107, the cooling duct 108, and the suction fan 110 from the image forming apparatus 1 according to the embodiment and mounting such a cooling structure as that described below on the apparatus. In the image forming apparatus of Comparative Example 2, a straight pipe corresponding to the inlet duct 112 illustrated in FIG. 4 is attached to the writing-unit cooling duct 23*a* illustrated in FIG. 5. In the image forming apparatus of Comparative Example 2, the lower portion of the inside-than-container inner cover 106 is unoccupied. The pipe attached to the writing-unit cooling duct 23*a* is open toward the toner container 70 from this lower portion of the inside-than-container inner cover 106. Air flowing inside the writing-unit cooling duct 23*a* naturally flows into this pipe and comes out from the opening of this pipe to impinge on the toner container 70.

Each of the image forming apparatus of Comparative Example 1 and that of Comparative Example 2 was operated continuously for three hours to form the predetermined test images in a controlled temperature environment of 32° C. as was the image forming apparatus 1 according to the embodiment. The temperature at a position near the bottom of the toner container 70 or, in other words, immediately above the fixing device 30, was measured every hour.

Figure 9:
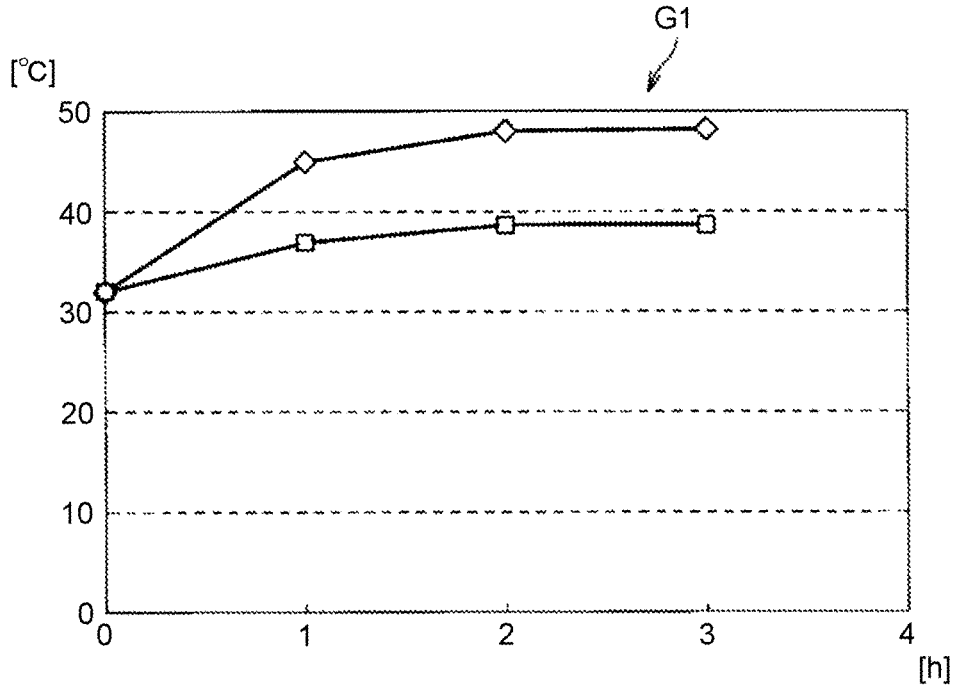
FIG. 9 is a graph representing results of experiment carried out on the image forming apparatus according to the embodiment and those of Comparative Examples.

FIG. 9 is a graph representing results of the experiment carried out on the image forming apparatus according to the embodiment and those of Comparative Examples. In graph G1 illustrated in FIG. 9, temperature is plotted on the vertical axis and time on the horizontal axis. In the graph G1, measurement results obtained from the image forming apparatus 1 according to the embodiment are indicated by squares. The measurement results of the two Comparative Examples were substantially equal to each other. Accordingly, average values of the measurement results obtained from the image forming apparatus of Comparative Examples 1 and 2 are indicated by diamonds. As can be seen from the graph G1 illustrated in FIG. 9, the cooling structure of the image forming apparatus 1 according to the embodiment achieves cooling to temperatures lower than those achieved using the cooling structure, which simply blows air against the toner container 70, of the image forming apparatuses of the two Comparative Examples by as much as approximately 10° C. Such a high cooling effect is considerably advantageous when using toner which can be fixed at a lower temperature.

In the image forming apparatus 1 according to the embodiment, as illustrated in FIG. 2, the air blown against the outer circumferential surface of the toner container 70 flows through the airflow path 109 in the manner to circumferentially surround the outer circumferential surface of the toner container 70, and thereafter is sucked by the suction fan 110. Thus, current of air that flows surrounding the outer circumferential surface of the toner container 70 without stagnating is formed. The toner container 70 will be effectively cooled by the air flowing without stagnating in this manner as verified by the experiment described above. Furthermore, in contrast to the cooling structure disclosed in Japanese Laid-open Patent Application No. 2008-064901 which runs cooling fluid through a pipe, the image forming apparatus 1 according to the embodiment does not require expensive and space-demanding components such as a pump and a tank for the fluid. Accordingly, the image forming apparatus 1 according to the embodiment can reduce an increase in manufacturing cost and size of the image forming apparatus as compared with the cooling structure which runs cooling fluid through a pipe. As described above, the image forming apparatus 1 according to the embodiment can effectively cool the toner container 70 while reducing an increase in manufacturing cost and size of the image forming apparatus.

In the image forming apparatus 1 according to the embodiment, as illustrated in FIG. 2, the exhaust duct 111 through which air that has cooled the toner container 70 has the shape of the hollow cover extending so as to conceal the toner container 70 in top view of the fixing device 30 which is likely to be a heat source. The exhaust duct 111 shields the toner container 70 from radiant heat emitted from the fixing device 30 and high-temperature ambient air rising from the fixing device 30 by natural convection. Furthermore, a temperature rise of the exhaust duct 111 in itself is reduced by cooling provided by the air flowing inside the exhaust duct 111. Accordingly, heat radiation from the exhaust duct 111 and a temperature rise in the ambient air caused by the exhaust duct 111 are also reduced. The image forming apparatus 1 according to the embodiment is configured to further effectively cool the toner container 70 by virtue of the shielding provided by the exhaust duct 111 and the cooling of the exhaust duct 111 by itself.

In the image forming apparatus 1 according to the embodiment, the air inside the cooling duct 108 is guided by the multiple cooling-duct flow-smoothing plates 112*c* illustrated in FIG. 4 to blow the air so that the amount of air blown against the outer circumferential surface of the toner container 70 varies depending on the position on the outer circumferential surface in a manner that the amount increases toward the fixing device 30 where the temperature is likely to increase. Efficiency in cooling of the outer circumferential surface of the toner container 70 is thus increased.

In the image forming apparatus 1 according to the embodiment, the air in the exhaust duct 111 is guided by the multiple exhaust-duct flow-smoothing plates 111*c* illustrated in FIG. 7 so that the air inside the exhaust duct 111 is discharged after being distributed substantially evenly in the exhaust duct 111. By virtue of this structure, the image forming apparatus 1 according to the embodiment cools the exhaust duct 111 located above the fixing device 30 evenly, thereby further reducing a temperature rise in the exhaust duct 111.

In the image forming apparatus 1 according to the embodiment, as illustrated in FIG. 2, the cooling duct 108 causes air exiting therefrom to impinge on the outer circumferential surface of the toner container 70 substantially perpendicularly. As a result, the air is distributed upward and downward with respect to the toner container 70 substantially evenly, and therefore the cooling effect is exerted on the outer circumferential surface of the toner container 70 substantially evenly in the circumferential direction.

In the image forming apparatus 1 according to the embodiment, as illustrated in FIG. 2, the front door 101, which is one of the walls that define the airflow path 109, has the shape that causes the air to flow to circumferentially surround the outer circumferential surface of the toner container 70 and guides the air to the suction fan 110. Accordingly, the air passed through the airflow path 109 is smoothly sucked by the suction fan 110.

Furthermore, in the image forming apparatus 1 according to the embodiment, the maximum flow rate of the suction fan 110 is set to be equal to or greater than the maximum flow rate of the cooling fan 107. Because this setting causes the air to flow through the airflow path 109 smoothly and fast, more effective cooling of the toner container 70 can be achieved.

In the image forming apparatus 1 according to the embodiment, the rotation speed of the cooling fan 107 and that of the suction fan 110 are controlled according to the ambient temperature detected by the temperature sensor 115 as illustrated in FIG. 8. Power saving can be achieved by controlling the rotation speed of the cooling fan 107 and that of the suction fan 110 to those that are necessary and sufficient to cool the toner container 70.

The embodiments presented in the foregoing description are merely representative examples, and are not intended to limit the scope of the present disclosure. Various modifications and variations may occur to those skilled in the art based on known knowledge without departing from the scope of the present disclosure. It is to be understood that the present disclosure encompasses such modifications and variations as fall within the spirit and scope of the invention.

For instance, in the embodiment, the airflow path 109 configured to surround the approximately longitudinal half of the outer circumferential surface of the toner container 70 on the side close to the fixing device 30 is employed as an example of the outer-circumferential flow path according to aspects of the invention. However, the outer-circumferential flow path according to aspects of the invention is not limited thereto, and may alternatively be a flow path configured to surround the entire outer circumferential surface of the toner container 70, for example.

In the embodiment, the airflow path 109 defined by the outer circumferential surface of the toner container 70, and the inside-than-container inner cover 106, the operating-unit inner cover 114, the front door 101, and the upper wall 111*a* of the exhaust duct 111 is employed as an example of the outer-circumferential flow path according to aspects of the invention. However, the outer-circumferential flow path according to aspects of the invention is not limited thereto, and may alternatively be a flow path defined using a wall(s) other than the covers described above.

In the embodiment, the cylindrical toner container 70 is employed as an example of the toner container according to aspects of the invention. However, the toner container according to aspects of the invention is not limited thereto, and may alternatively a toner container having the shape of a rectangular prism, for example.

According to the embodiments described above, air is caused to circumferentially flow through an outer-circumferential flow path arranged on an outer circumferential surface of a toner container, and thereafter sucked by a suction fan. A flow of the air surrounding the outer circumferential surface of the toner container without stagnating is thus formed. The toner container will be effectively cooled by the air flowing in this manner without stagnating.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming device to form a toner image on a sheet;

a fixing device to fix the toner image on the sheet;

a toner container to house the toner to be supplied to the image forming device, the toner container arranged directly over the fixing device;

a cooling fan;

a guide to guide an airflow coming from the cooling fan to an outer circumferential surface of the toner container;

an outer-circumferential flow path to serve as an airflow path between the outer circumferential surface and a wall facing the outer circumferential surface, the outer-circumferential flow path guiding the airflow coming from the guide along the outer circumferential surface;

a suction fan to suck the airflow having passed through the outer-circumferential flow path; and an exhaust guide to discharge the airflow sucked by the suction fan.

2. The image forming apparatus according to claim 1, wherein the exhaust guide is located between the fixing device and the toner container and has a shape of a hollow cover extending so as to conceal the toner container when viewed from the fixing device.

3. The image forming apparatus according to claim 1, wherein a guide flow-smoothing plate is located inside the guide, the guide flow-smoothing plate guiding the airflow flowing inside the guide so that an amount of the airflow at a portion of the outer circumferential surface closer to the fixing device is larger.

4. The image forming apparatus according to claim 1, wherein an exhaust-guide flow-smoothing plate is located inside the exhaust guide, the exhaust-guide flow-smoothing plate guiding the airflow coming from the suction fan so that the airflow is discharged after being evenly distributed inside the exhaust guide.

5. The image forming apparatus according to claim 1, wherein the guide is configured to cause the airflow to impinge on the outer circumferential surface of the toner container substantially perpendicularly.

6. The image forming apparatus according to claim 1, wherein a maximum flow rate of the suction fan is equal to or greater than a maximum flow rate of the cooling fan.

7. The image forming apparatus according to claim 1, further comprising:

a temperature detector located near the outer circumferential surface to detect a temperature near the outer circumferential surface; and a controller to control rotation speed of the cooling fan and rotation speed of the suction fan according to the temperature detected by the temperature detector.

8. The image forming apparatus according to claim 1, wherein the cooling fan is located at a junction with a writing unit cooling duct.

9. The image forming apparatus according to claim 1, wherein a wall of the exhaust guide forms a portion of the outer-circumferential flow path.

10. The image forming apparatus according to claim 1, wherein a wall of an exterior door of the image forming apparatus forms a portion of the outer-circumferential flow path.

11. The image forming apparatus according to claim 1, wherein the suction fan is located directly beneath the toner container.

12. The image forming apparatus according to claim 1, wherein the exhaust guide is over the fixing device.

13. An image forming apparatus comprising:

an image forming device to form a toner image on a sheet;

a fixing device to fix the toner image on the sheet;

a toner container to house the toner to be supplied to the image forming device, the toner container arranged over the fixing device;

a cooling fan;

a guide to guide an airflow coming from the cooling fan to an outer circumferential surface of the toner container;

an outer-circumferential flow path to serve as an airflow path between the outer circumferential surface and a wall facing the outer circumferential surface, the outer-circumferential flow path guiding the airflow coming from the guide along the outer circumferential surface;

a suction fan to suck the airflow having passed through the outer-circumferential flow path; and an exhaust guide to discharge the airflow sucked by the suction fan, wherein the wall is a front door of the image forming apparatus.

* * * * *